US006679392B1

(12) United States Patent
Costa

(10) Patent No.: US 6,679,392 B1
(45) Date of Patent: Jan. 20, 2004

(54) SLIDING HANGER ASSEMBLY

(75) Inventor: Charles A. Costa, Lincroft, NJ (US)

(73) Assignee: Sidelines, Inc., Lincroft, NJ (US)

( * ) Notice: Subject to any disclaimer, the term of this patent is extended or adjusted under 35 U.S.C. 154(b) by 0 days.

(21) Appl. No.: 10/053,757

(22) Filed: Jan. 22, 2002

(51) Int. Cl.[7] ..... A47F 5/08

(52) U.S. Cl. ..... 211/94.01; 211/85.3; 211/162; 312/334.11

(58) Field of Search ..... 211/94.01, 162, 211/175, 94.02, 85.3; 312/334.11, 334.15, 334.17, 334.25, 334.26, 334.33, 334.38

(56) References Cited

U.S. PATENT DOCUMENTS

| | | | | | |
|---|---|---|---|---|---|
| 2,683,890 | A | * | 7/1954 | Rosenbaum | 211/94.01 |
| 2,917,185 | A | * | 12/1959 | Kovacs | 211/94.01 |
| 3,954,182 | A | | 5/1976 | McEvers | 211/94 |
| 3,966,273 | A | * | 6/1976 | Hagen et al. | 312/334.17 |
| 4,569,450 | A | | 2/1986 | Dillingham | 211/96 |
| 5,215,201 | A | | 6/1993 | Seymour | 211/123 |
| 5,337,905 | A | | 8/1994 | Gast | 211/87 |
| 5,425,463 | A | | 6/1995 | Toscanini et al. | 211/96 |
| 5,538,146 | A | | 7/1996 | Gast | 211/105.1 |
| 6,173,871 | B1 | | 1/2001 | Woodworth | 223/94 |
| 6,378,968 | B1 | * | 4/2002 | Weng | 312/334.11 |
| 6,416,145 | B1 | * | 7/2002 | Singh | 312/334.1 |

* cited by examiner

*Primary Examiner*—Robert W. Gibson, Jr.
*Assistant Examiner*—Erica B. Harris
(74) *Attorney, Agent, or Firm*—Vidas, Arrett & Steinkraus, P.A.

(57) ABSTRACT

A hanger assembly comprises a housing, an outer rail, an inner rail and a slide member. The housing defines a chamber with at least one longitudinal opening. Within the chamber, the outer rail is fixedly mounted in a substantially parallel position relative to the longitudinal axis of the housing. The inner rail is slidingly engaged to the outer rail. The slide member is slidingly engaged to the inner rail. At least a portion of the slide member extends from the chamber through the at least one opening in the housing. The slide member is constructed and arranged to be moveable relative to the inner rail and the inner rail is constructed and arranged to be moveable relative to the outer rail, such that when the slide member is moved relative to the inner rail, the inner rail is simultaneously moved relative to the outer rail.

10 Claims, 7 Drawing Sheets

SLIDING HANGER ASSEMBLY

BACKGROUND OF THE INVENTION

1. Field of the Invention

The present invention is directed to several different embodiments of sliding rail assemblies. Embodiments of the present invention are particularly directed to sliding rail assemblies for use with a closet partition or other surface or member suitable for mounting thereto. More particularly, some embodiments of the present invention are directed to sliding rail assemblies which include attachments for hanging belts, ties or other articles. When the unique sliding rail assembly is mounted to a vertically oriented partition or other member, an attachment affixed to the sliding rail is capable of being slid between retracted and extended positions. Any articles of clothing placed on the attachment may thus be extended outward from a retracted position from within a closet or other space to be readily and conveniently accessed by a operator. Subsequently the attachment and any articles remaining thereon may be slid back to the retracted position.

2. Description of the Related Art

There are currently available many types of tie racks, belt racks, valet rods (garment bag holders) and other hanger racks for hanging articles of clothing thereon. Many such racks include sliding mechanisms to allow the rack to be slid from a retracted position to a more easily accessed extended position.

Such sliding racks include the retractable valet rods described in U.S. Pat. Nos. 5,337,905 and 5,538,146. Other rack assemblies are known that include sliding or otherwise moveable members which may cause hanging members to be actuated. Such assemblies are described in U.S. Pat. Nos. 4,569,450 and 5,425,463.

Hanging racks are known that are varied in design and function. However, there continues to exist a need in the art to provide for a sliding rail assembly that may be mounted to a wall, partition or other member, such that an hanger attachment may be engaged to the sliding rail assembly to allow a user to slidingly extend the hanger attachment from a retracted position to an extended position. While sliding rail assemblies are known, those that are presently available fail to provide a sliding rail assembly that has both a smooth sliding action, as well as the ability to mount one or more of a variety of hanger attachments. It is also desired to provide a sliding rail hanger assembly that is durable, reliable, fully contained within a housing and that may be readily installed without a great degree of precision required. Various embodiments of the present invention provide for such a sliding rail hanger assembly, and also provide an assembly that is esthetically pleasing, and which is particularly useful when mounted to a vertical surface a closet wall, partition, door or other member.

All U.S. patents and applications and all other published documents mentioned anywhere in this application are incorporated herein by reference in their entirety.

The invention in various of its embodiment is summarized below. Additional details of the invention and/or additional embodiments of the invention may be found in the Detailed Description of the Invention below.

The abstract provided herewith is intended to comply with 37 CFR 1.72 and is not intended be used in determining the scope of the claimed invention.

BRIEF SUMMARY OF THE INVENTION

The present invention is embodied in several different forms. In at least one embodiment, the invention is directed to a sliding rail assembly for providing an extendable and/or retractable hanger for hanging clothes, clothing accessories or other articles thereon. Preferably, the sliding hanger assembly is constructed and arranged to be mounted to a door, wall, partition or other vertical member of a closet or other location.

In at least one embodiment of the invention the sliding rail assembly has an engagement member for engaging one or more of a variety of hanger attachments. Hanger attachments may include one or more: valet rods, tie racks, belt racks, hangers (clothing or otherwise) hooks, or other devices for hanging garments, clothing accessories or other articles.

In at least one embodiment, the sliding rail assembly comprises a housing which substantially contains an outer rail, an inner rail, and a slide equipped with an engagement member. In some embodiments, the outer rail is fixedly engaged within the housing and contains, in a sliding relationship, the inner rail. The inner rail engages the slide in a sliding relationship as well. Preferably, the inner rail includes one or more ball bearing containment members which contain a plurality of ball bearings. The ball bearings provide a rolling or sliding relationship between the outer rail and inner rail, as well as the rolling or sliding relationship between the inner rail and slide.

In some embodiments, the housing defines an opening through which the hanger engagement member of the slide extends through in order to be accessible from outside the housing. In some embodiments, the hanger engagement member includes a hanger attachment such as a valet rod, tie rack, belt rack or other hanger assembly. Preferably, the hanger engagement member is constructed and arranged to be capable of removable receipt of one or more of a variety of similar or different hanger attachments.

In various embodiments of the invention the housing, as well as other components, may be manufactured from metal such as stainless steel, aluminum, titanium, etc. Other materials suitable for use in constructing the components of the present invention may include engineering and/or reinforced plastic. Preferably, the housing and/or other components have a protective coating of plastic, chrome or other material to protect the housing from cosmetic damage, such as scratches and denting.

Further aspects of the invention will become apparent from the detailed description which follows.

BRIEF DESCRIPTION OF THE SEVERAL VIEWS OF THE DRAWINGS

A detailed description of the invention is hereafter described with specific reference being made to the following drawings.

DETAILED DESCRIPTION OF THE INVENTION

While this invention may be embodied in many different forms, there are described in detail herein specific preferred embodiments of the invention. This description is an exemplification of the principles of the invention and is not intended to limit the invention to the particular embodiments illustrated.

Figure 1:
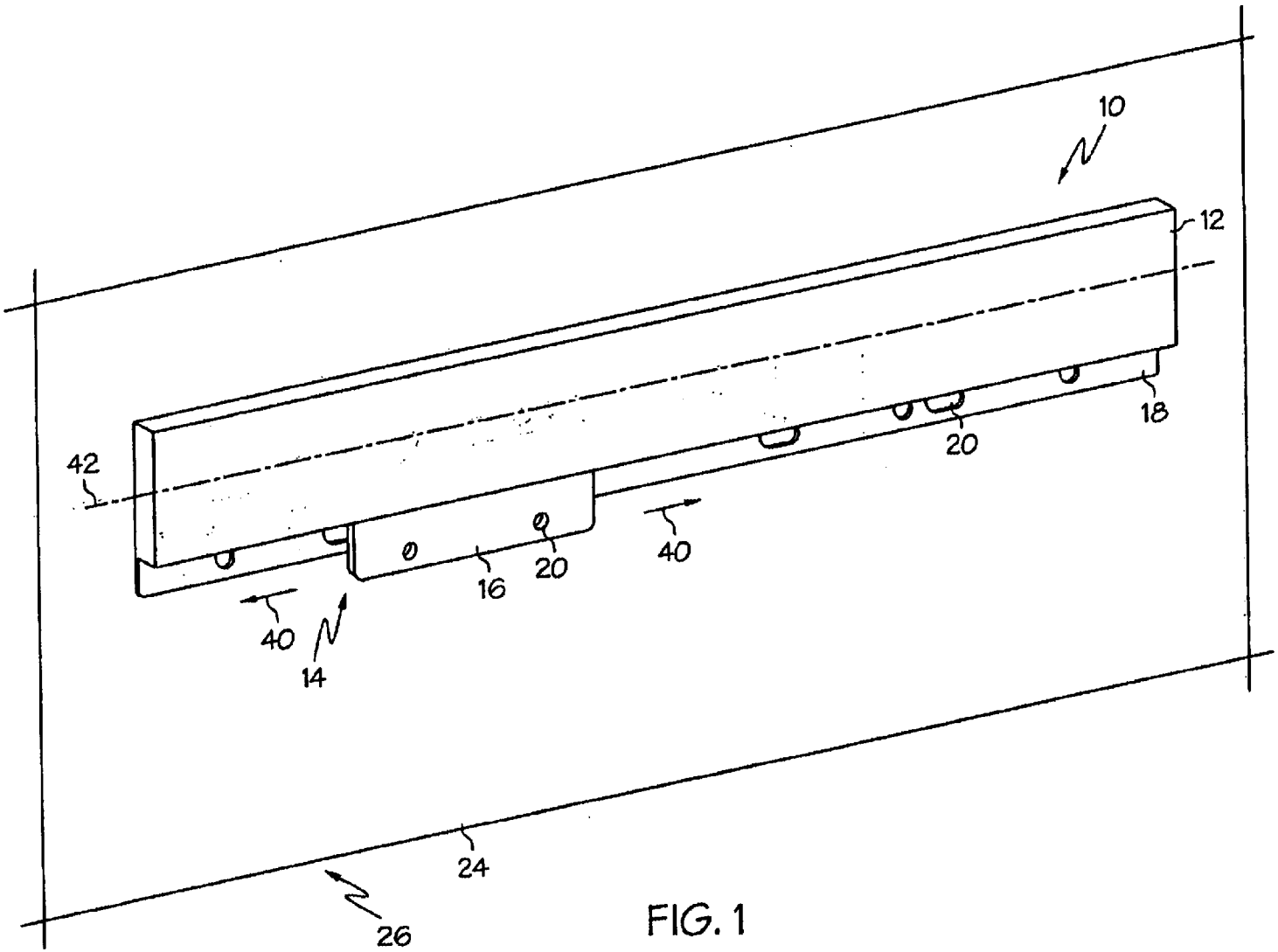
FIG. 1 is a perspective view of an embodiment of the invention.

As indicated above, the present invention may be embodied in many forms. In FIG. 1, an embodiment of the sliding hanger assembly is shown generally at 10. In the embodiment shown, the hanger assembly 10 comprises a housing 12, which defines a chamber 54 (shown in FIG. 2) within which a slide 14 is housed. The slide 14 includes a hanger attachment engagement member 16 which is constructed to receive one or more of a variety of hanger attachments 30 such as a valet rod 32, belt rack 34 and/or tie rack 36 such as are respectively shown in the embodiments shown in FIGS. 5–7. The various attachments may be secured to the hanger attachment engagement member 16 in any manner desired. In the embodiments shown in FIGS. 5–7 however, attachments 30 may be fixedly or removably engaged to the hanger attachment engagement member 16 through the use of fastener devices 22. In order to accommodate fastener devices 22, both the attachment 30 and the hanger attachment engagement member 16 define one or more securement openings 20, through which a fastener device 22, may be inserted. Fastener devices 22 may be any type of fastening device including but not limited to nails, screws, bolts (and nuts), tie members, etc. Alternatively, the individual attachments 30 may be affixed to the hanger attachment engagement member 16 using other attachment methods including the use of hook and loop fabric, chemical welding, application of adhesive(s), heat welding, soldering, riveting, etc.

In the embodiment shown in FIG. 1, the housing 12, includes an engagement tab 18. The engagement tab 18 defines one or more securement openings 20 through which a fastener device 22 is inserted in order to engage the assembly 10 to a surface 24 of a member 26. Housing 12 may also be engaged to a surface 24 in any manner desired. Some examples of suitable engagement methods have been described above.

Figure 2:
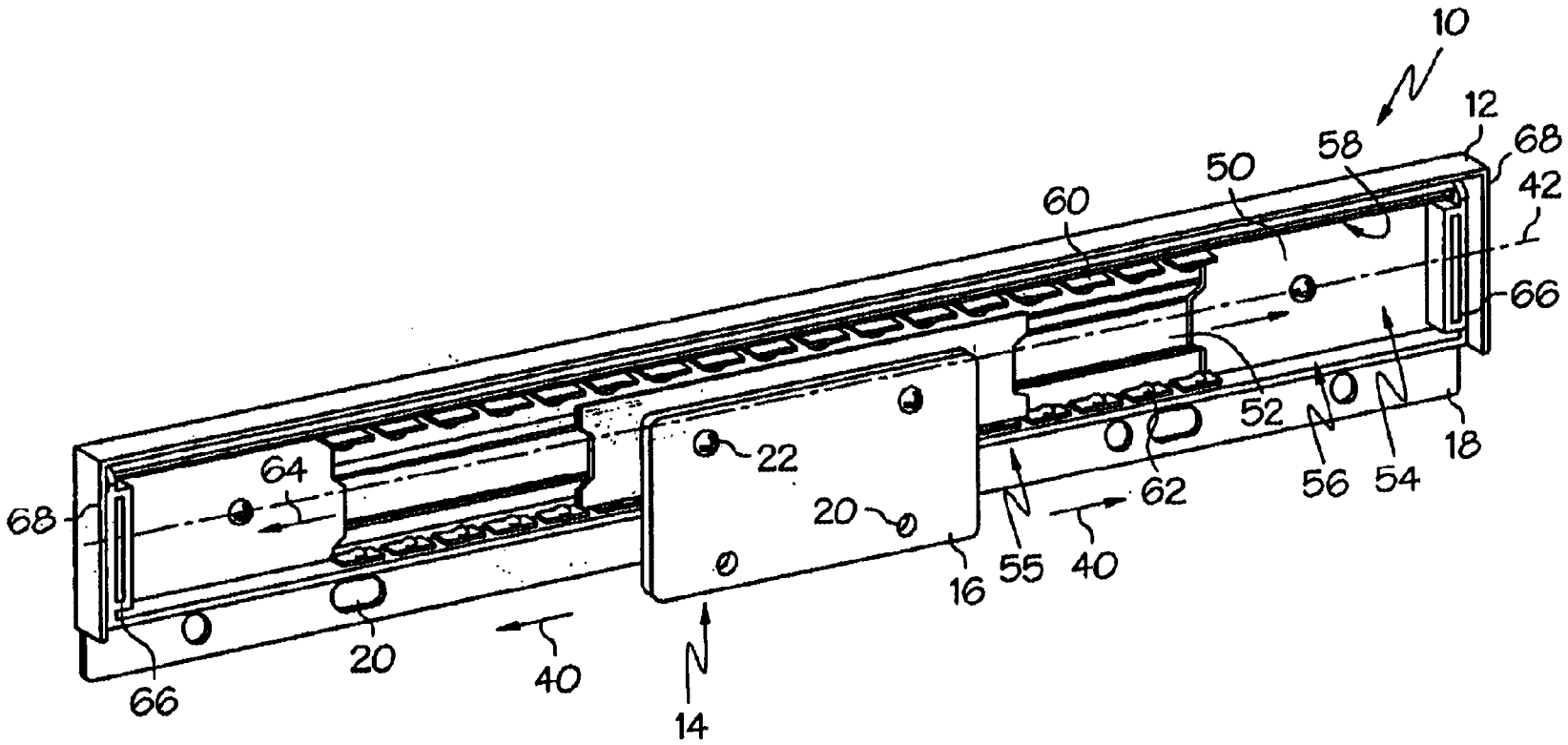
FIG. 2 is a longitudinal cut away perspective view of an embodiment of the invention shown in FIG. 1.
Figure 3:
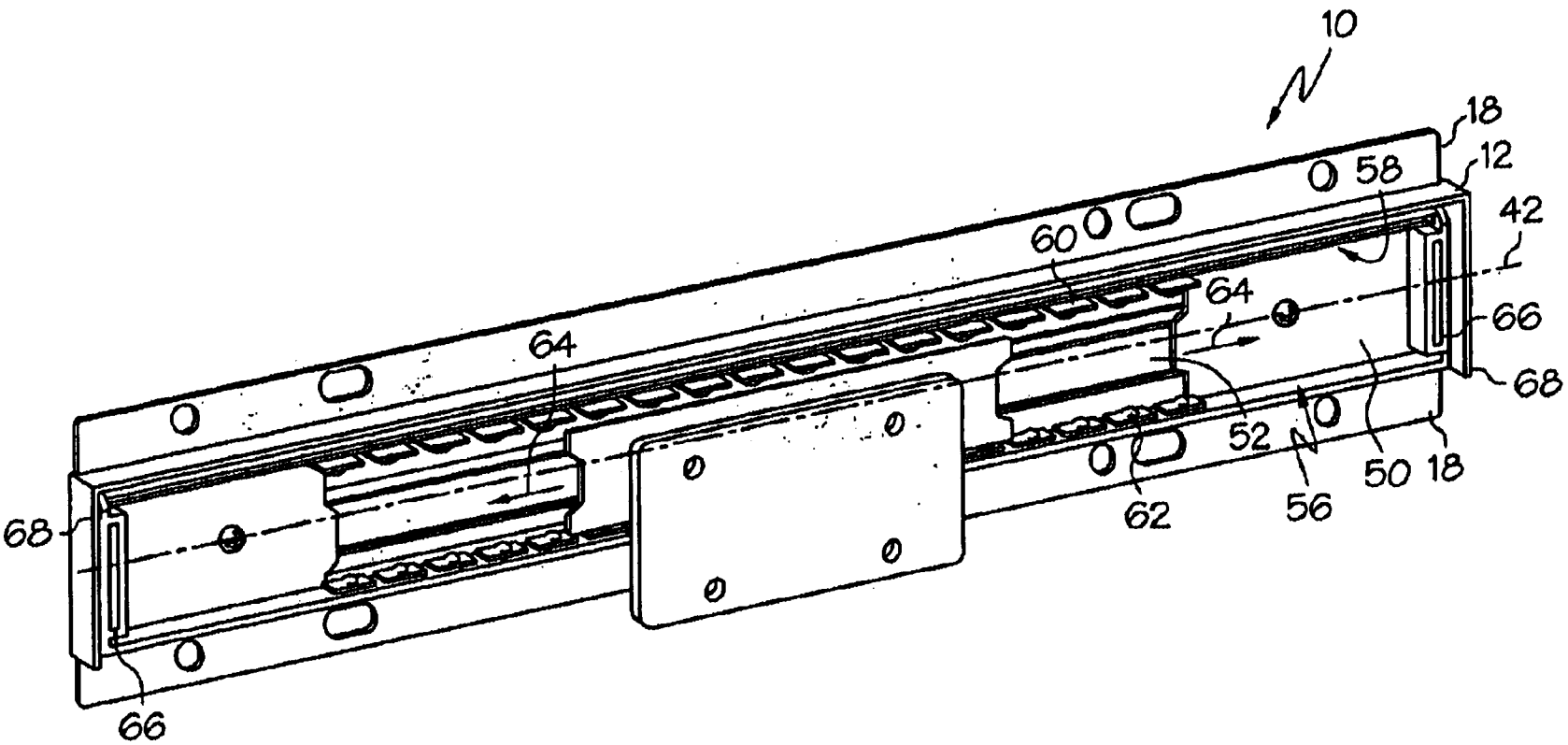
FIG. 3 is a longitudinal cut away perspective view of an embodiment of the invention.

In an alternative embodiment of the invention shown in FIG. 3, the assembly 10 may be equipped with two engagement tabs 18. In the embodiments shown in FIGS. 1–3, engagement tabs 18 are shown oriented in a position parallel to the longitudinal axis 42 of the assembly 10. It should be noted however, that the present invention is also directed to assemblies 10 which include engagement tabs 18 that are mounted in any position, and on any surface relative to the housing 12, as may be desired.

In reference to FIG. 1, member 26, is preferably a vertically oriented door, wall, partition, separator or other structural component of a closet or other area having sufficient structural strength to engagingly support the assembly 10 and any articles which may be hung therefrom.

In the various embodiments described herein, the slide 14 which defines the hanger attachment engagement member 16 is movable relative to the housing 12 in a front to back manner, as indicated by arrows 40, parallel to the longitudinal axis 42 of the assembly 10. The slide 14 is able to provide a smooth sliding motion relative to the housing 12 as a result of the double sliding rail relationship between outer rail 50, inner rail 52, and slide 14, such as is shown in FIG. 2.

In FIG. 2, the assembly 10 is shown with the front panel of housing 12 cut away. In this view the internal components of assembly 10 are visible.

Figure 5:
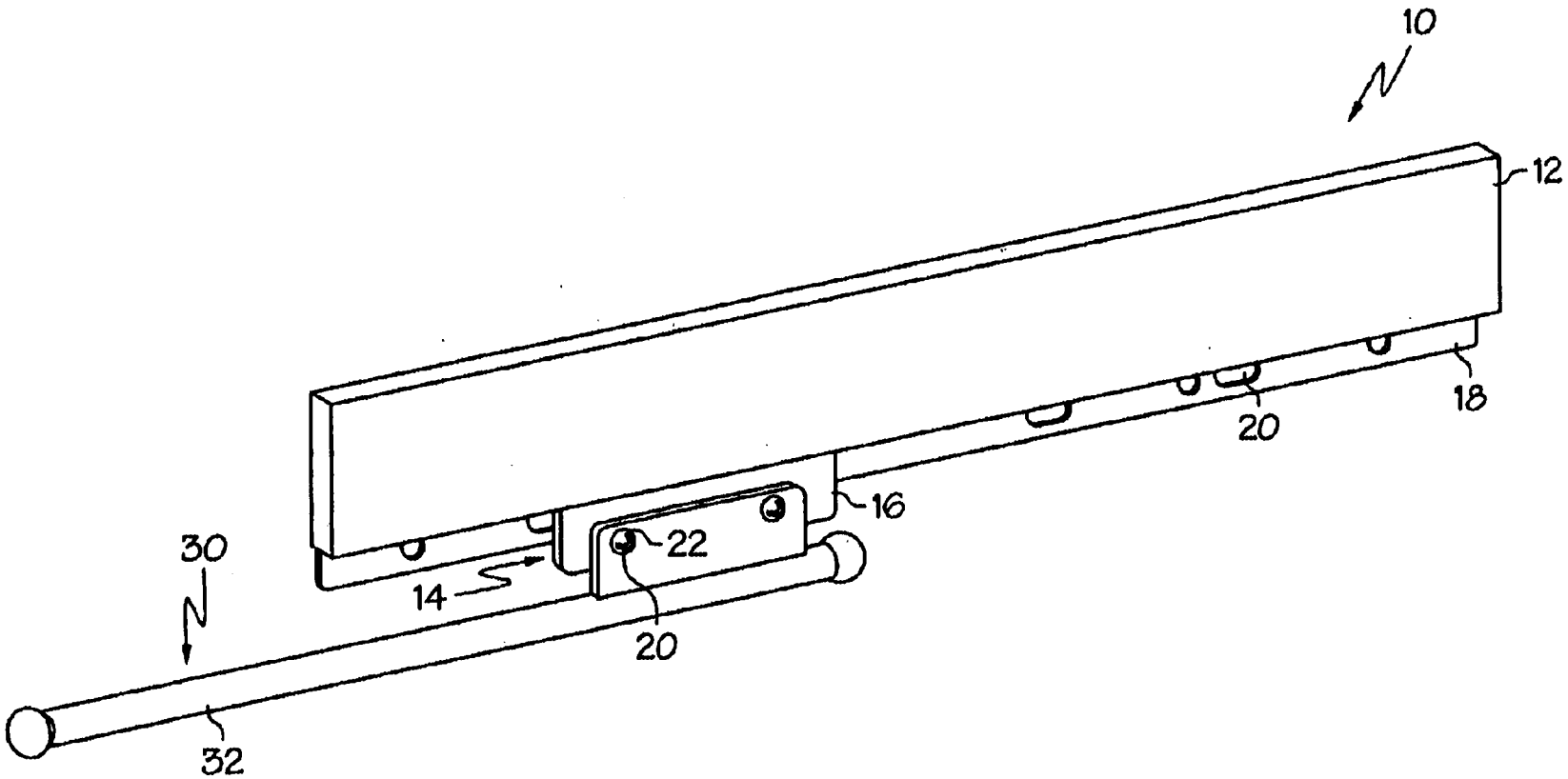
FIG. 5 is a perspective view of an embodiment of the invention.
Figure 6:
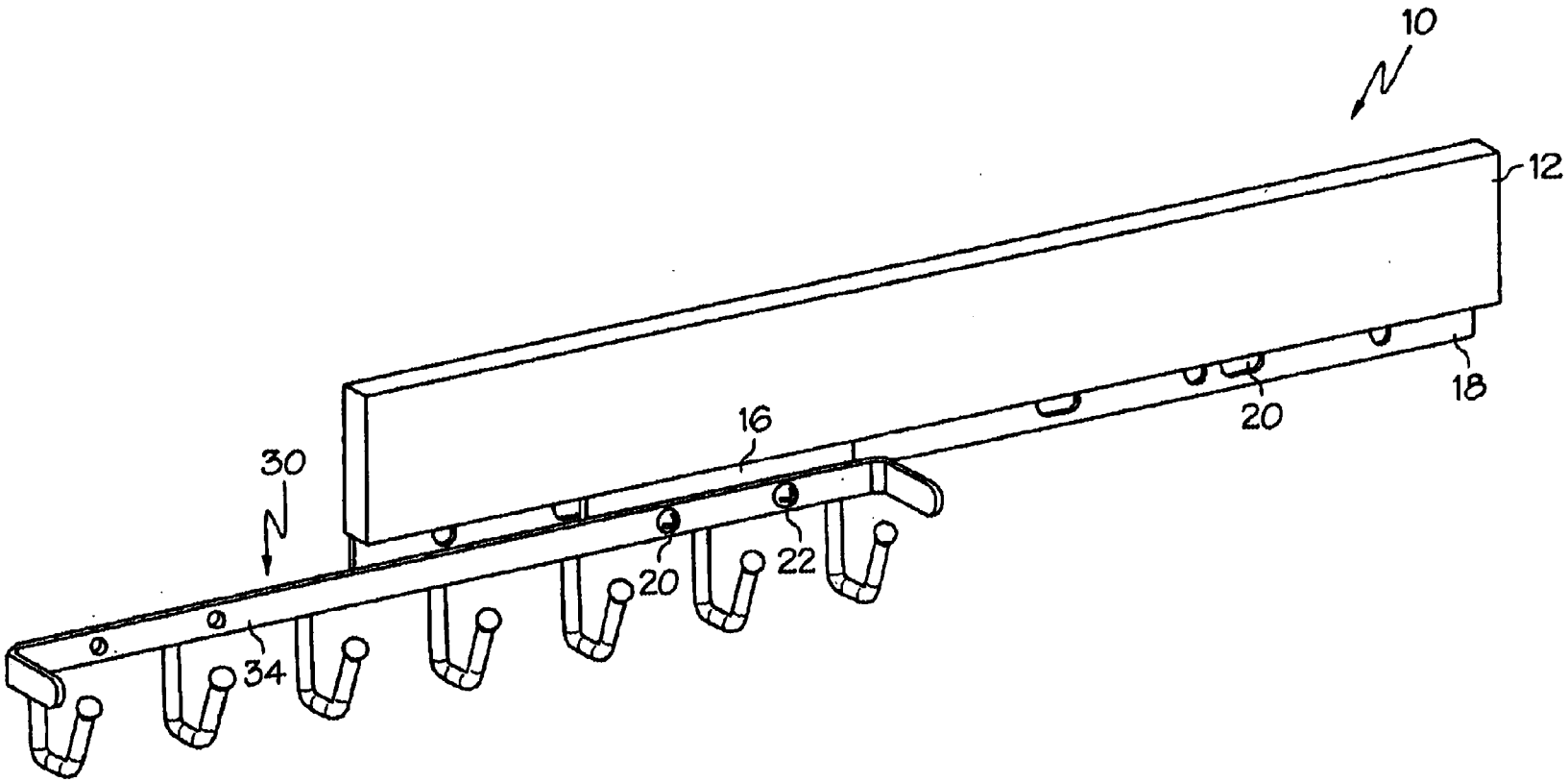
FIG. 6 is a perspective view of an embodiment of the invention.
Figure 7:
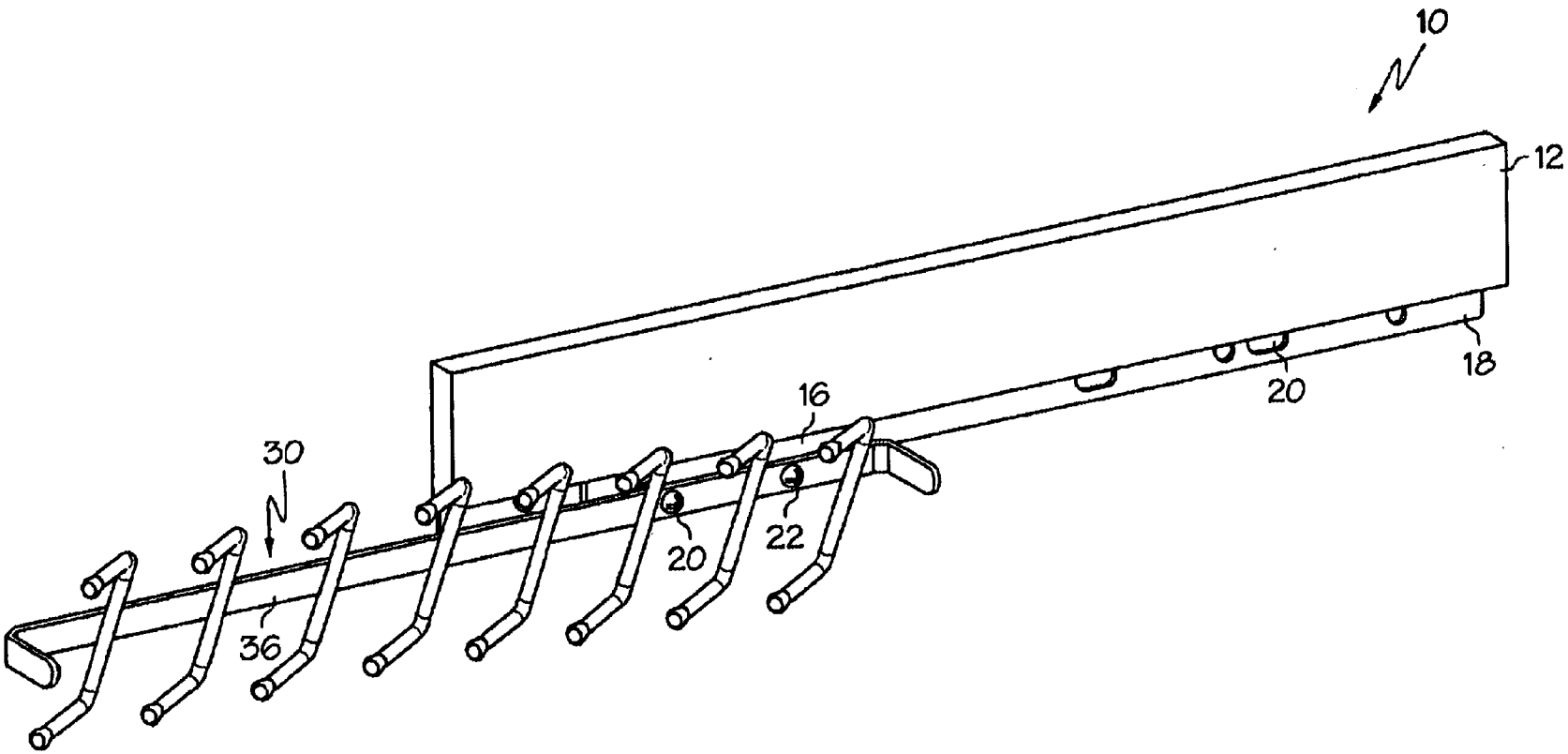
FIG. 7 is a perspective view of an embodiment of the invention.

As previously mentioned, housing 12 defines a chamber 54. Chamber 54 has an opening 55 defined by the housing 12, which allows the hanger attachment engagement member 16 of slide 14 to extend out of the chamber 54 where it may engage the one or more attachments 30 as shown in FIGS. 5–7. In the various embodiments shown in FIGS. 1–7, hanger attachment engagement member 16 of slide 14 may be an integral portion of the slide 14 or may be a separate member attached to the slide 14 using fastener devices 22 or any of the engagement methods previously described.

In the embodiment shown in FIG. 2, it is shown that chamber 54 contains the outer rail 50, which is fixedly mounted to the housing 12 within the chamber 54. Outer rail 50 is shown having a length substantially equal to that of the chamber 54. It should be noted however, that the outer rail 50 may have any length less than or substantially equal to the length of the chamber 54.

Figure 4:
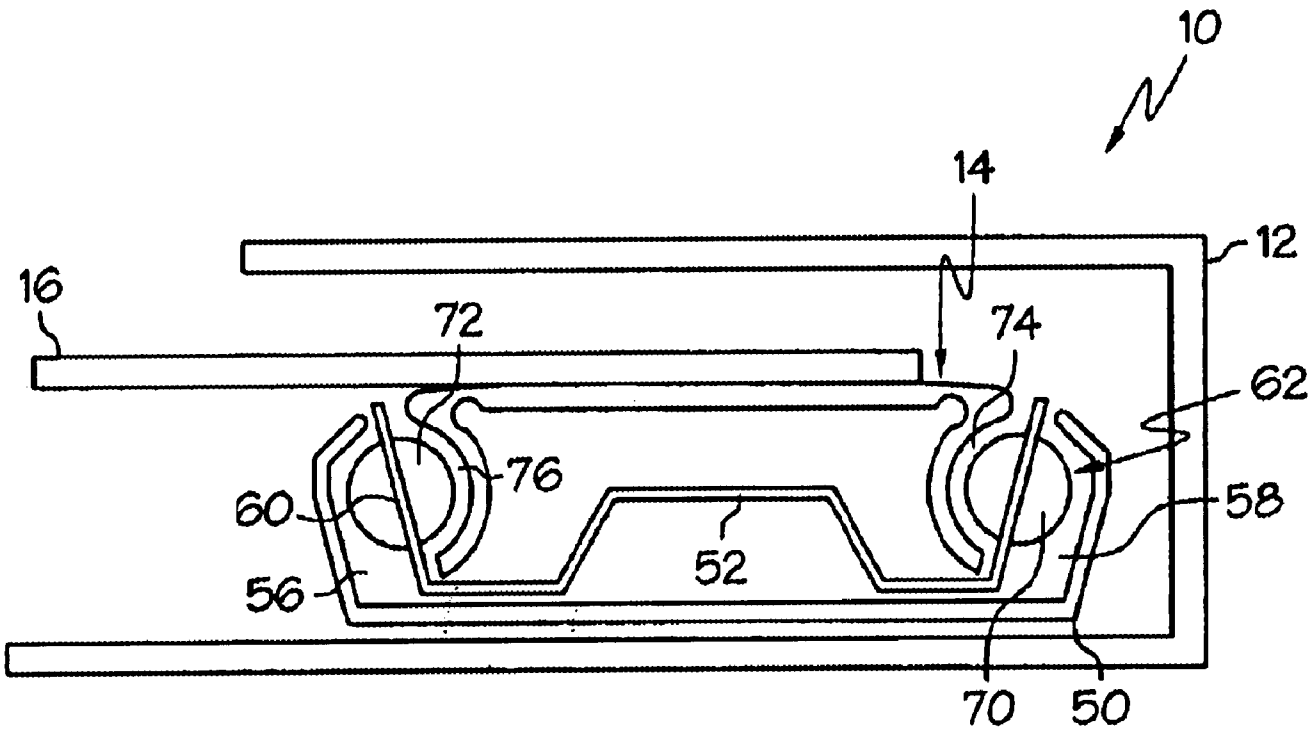
FIG. 4 is an enlarged cross-sectional view of the embodiment shown in FIG. 2.

As shown in FIGS. 2–4, outer rail 50 defines a pair of inner rail engagement surfaces or channels 56 and 58 which slidingly engage inner rail 52. The sliding relationship between inner rail 52 and outer rail 50 is achieved through the use of ball bearings 62 which are held between channels 56 and 58 of the outer rail 50 and ball bearing engagement tabs 60 of the inner rail 52. In this manner, the ball bearings 62 are sandwiched between tabs 60 and a respective channel 56 and 58. As a result, the ball bearings 62 effectively retain the inner rail 52, via tabs 60, within the confines of the channels 56 and 58 of the outer rail 50, as is shown in FIG. 4.

In FIG. 4 the various components of assembly 10 are shown spaced apart to better illustrate the various relationships between components.

The unique relationship between inner rail 52 and outer rail 50 provides for an extremely secure fit between the rails 50 and 52 which minimizes rattling between the rails thereby ensuring that the inner rail 52 has a particularly smooth back and forth sliding motion, indicated by arrows 64 in FIGS. 2 and 3, relative to the outer rail 50. In the embodiments shown in FIGS. 2 and 3, outer rail 50 also includes one or more longitudinal stops 66 which restrict the extent of the inner rail movement 64. The longitudinal stops 66, also function to protect the ends 68 of the housing 12 form contact or impact from the inner rail 52. Stops 66 may be positioned anywhere along the length of the outer rail 50.

In addition to providing the sliding engagement between the inner rail 52 and outer rail 50, the ball bearings 62 likewise provide a sliding engagement between the inner rail 52 and slide 14. As shown in FIG. 4, tabs 60 of inner rail 52, are constructed and arranged to allow a first portion 70 of each ball bearing 62 to pass through the tab 60 to rollingly engage one of the channels 56 and 58 of the outer rail 50. The tabs 60 are also constructed to allow a second portion 72 of each ball bearing 62 to pass through tab 60 to rollingly engage a respective slide channel 74 and 76 of the slide 14. As a result, the slide 14 is held slidingly engaged to the inner rail 52 in much the same manner that the inner rail 52 is engaged to the outer rail 50. The slide is thus capable of a back and forth motion, indicated by arrows 40 in FIGS. 2 and 3, relative to the inner rail 52.

By providing the inner rail 52 with tabs 60 that allow ball bearings 62 mounted therein to engage both the outer rail 50 and the slide 14, the present invention provides for a sliding rail relationship wherein inner rail 52 is slidingly moveable relative to the outer rail 50 and the slide 14 is simultaneously slidingly moveable relative to the inner rail 52. The rotation of the ball bearings 62 caused by movement of the slide 14, thereby causes the inner rail 52 to be moved relative to the outer rail 54 at substantially the same rate as the slide. As a result, when an attachment 30, such as are shown in FIGS. 5–7, is pulled or pushed, both the slide 14 and inner rail 52 slidingly move to extend or retract the attachment 30 relative to the housing 12.

In addition to being directed to the specific combinations of features claimed below, the invention is also directed to embodiments having other combinations of the dependent features claimed below and other combinations of the features described above.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

What is claimed is:

1. A hanger assembly comprising:

a housing, the housing defining a chamber, the housing farther defining at least one opening in the chamber, the at least one opening extending substantially from a first end of the housing to a second end of the housing;

an outer rail, the outer rail being fixedly mounted within the chamber and being substantially parallel to a longitudinal axis of the housing, the outer rail being entirely contained within the chamber;

an inner rail, the inner rail being slidingly engaged to the outer rail; and a slide member, the slide member being slidingly engaged to the inner rail, at least a portion of the slide member extending from the chamber through the at least one opening in the housing, the slide member constructed and arranged to be moveable in a back and forth manner relative to the inner rail and the inner rail constructed and arranged to be moveable in a back and forth manner relative to the outer rail, such that when the slide member is moved relative to the inner rail, the inner rail is simultaneously moved relative to the outer rail.

2. The hanger assembly of claim 1 further comprising at least one hanger attachment, the at least one hanger attachment being engaged to the at least a portion of the slide member.

3. The hanger assembly of claim 2 wherein the at least one hanger attachment is selected from at least one member of the group consisting of: valet rods, tie racks, belt racks, clothing racks, hangers, hooks, and any combination thereof.

4. The hanger assembly of claim 3 wherein the inner rail comprises a plurality of ball bearing support tabs and a plurality of ball bearings, each of the plurality of ball bearing support tabs being engaged to a portion of at least one ball bearing, a second portion of each ball bearing being rollingly engaged to the at least a portion of the outer rail.

5. The hanger assembly of claim 4 wherein the outer rail comprises a first channel and a second channel at least one of the first channel and second channel being rollingly engaged by the second portion of each ball bearing.

6. The hanger assembly of claim 2 wherein the at least a portion of the slide member extending from the chamber through the at least one opening in the housing defines at least one securement opening, the at least one securement opening constructed and arranged to receivingly engage at least one fastener device, the at least one fastener device constructed and arranged to engage at least a portion of the at least one hanger attachment to the at least a portion of the slide member extending from the chamber through the at least one opening in the housing.

7. The hanger assembly of claim 2 wherein the at least one hanger attachment is removably engaged to the at least a portion of the slide member extending from the chamber through the at least one opening in the housing.

8. The hanger assembly of claim 7 wherein the at least one hanger attachment comprises a plurality of hanger attachments, the plurality of hanger attachments constructed and arranged to be interchangeably engaged to the at least a portion of the slide member extending from the chamber through the at least one opening in the housing.

9. The hanger assembly of claim 1 further comprising at least one mounting tab, the at least one mounting tab engaged to the housing, the at least one mounting tab constructed and arranged to engage a surface of a member adjacent to the housing.

10. The hanger assembly of claim 9 wherein the mounting tab defines at least one securement opening, the at least one securement opening constructed and arranged to receivingly engage at least one fastener device, the at least one fastener device constructed and arranged to engage the surface of the member adjacent to the housing.

* * * * *